United States Patent [19]

Voegeli

[11] 3,945,228

[45] Mar. 23, 1976

[54] COIN-RECEIVING MECHANISM FOR VENDING MACHINES

[76] Inventor: H. Carl Voegeli, 918 Gibbs Road, Venice, Fla. 33595

[22] Filed: Feb. 21, 1975

[21] Appl. No.: 551,988

[52] U.S. Cl. ..... 70/80; 70/39

[51] Int. Cl.[2] ..... E05B 65/44

[58] Field of Search ..... 194/1 A, 1 B, 54; 70/39, 70/78–80

[56] References Cited

UNITED STATES PATENTS

| | | | |
|---|---|---|---|
| 1,461,725 | 7/1923 | Cooper | 70/39 X |
| 2,738,049 | 3/1956 | Shepherd | 194/1 A |
| 3,636,739 | 1/1972 | Smedley | 70/39 X |
| 3,638,460 | 2/1972 | Berry et al. | 70/39 X |

*Primary Examiner*—Stanley H. Tollberg
*Attorney, Agent, or Firm*—Bacon & Thomas

[57] ABSTRACT

An improved coin-receiving apparatus for vending machines is described which provides a tamper-proof locking mechanism in combination with a pivotally-detachable front panel for easy access to the coin-receiving station.

5 Claims, 7 Drawing Figures

COIN-RECEIVING MECHANISM FOR VENDING MACHINES

CROSS REFERENCE TO RELATED APPLICATION

This is an improvement of the invention described in copending application Ser. No. 476,423 filed June 5, 1974 now U.S. Pat. No. 3,884,337, incorporated herein by reference and relied upon.

BACKGROUND OF THE INVENTION

DESCRIPTION OF THE PRIOR ART

The present invention relates to coin-operated vending machines and, more particularly, the locking mechanism for the coin-receiving portion thereof. Vending machines have allowed purveyors to widely distribute their goods to consumers at numerous, often remote locations without the need to incur expenses relating to, for example, overhead and personnel. Such features are particularly attractive when the merchant desires to sell small, low profit-margin products widely used by numerous consumers who desire the convenience of obtaining these goods readily during their daily routines.

However, with such widespread use of coin-operated vending machines, the merchant must be able to rely upon the sturdiness of the apparatus to protect both the commodity to be dispensed and the currency deposited therein. This is particularly true for vending machines such as, for example, those used for the dispensing of newspapers which are typically located on numerous street corners throughout a city. Thus, vandalism and theft become real concerns for the merchant.

Those vending machines currently available have not proved satisfactory in providing a measure of safety to the merchant who must often rely upon rather inadequate locking mechanisms or modify the apparatus to render it tamper-proof.

SUMMARY OF THE INVENTION

It is therefore the primary object of this invention to provide an extremely durable locking mechanism for a coin-operated vending machine, which locking mechanism provides tamper-proof security in a simple, yet efficient manner.

This and other objects of this invention will become apparent upon inspection of the following detailed description of the preferred embodiment when taken in conjunction with the figures of drawing.

According to the present invention, there is provided a positive locking mechanism comprised of a lock body member and an independent, cooperating lock shaft member adapted for insertion within the lock body and capable of effecting secure attachment therebetween. The lock shaft member is securely affixed integrally within the coin receptacle of the dispensing machine and is positioned in such a fashion that the shaft members protrude through the front panel of the coin receptacle cabinet. The front panel is provided with a recess closely correspondng to the external configuration of the lock body whereby the lock body may be firmly attached to the shaft member to achieve positive, tamper-proof securement of the front panel to the coin receptacle cabinet.

DETAILED DESCRIPTION OF THE PREFERRED EMBODIMENT

To more fully describe the essential features of the present invention, the following detailed description will be given as an exemplary, preferred embodiment. While the improved locking mechanism is capable of incorporation in numerous vending apparatus, the description will be made with reference to a newspaper vendng machine such as that described in copending application Ser. No. 476,423 filed June 5, 1974 now U.S. Pat. No. 3,884,337, it being appreciated that same is intended to be illustrative and in no way limitative.

Figure 1:
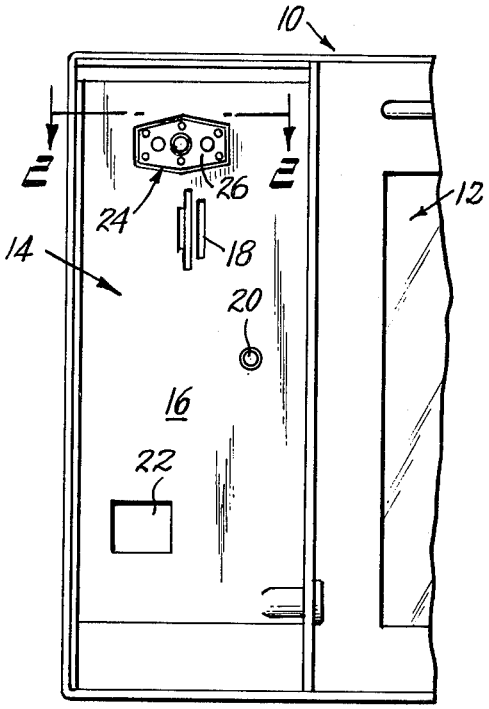
FIG. 1 is a fragmentary front elevational view of a dispensing device cabinet illustrating a modification of a removable front panel for receiving coins in payment for the merchandise to be dispensed therefrom.

FIG. 1 shows a coin-operated newspaper vending machine designated generally as 10 and comprised of a dispensing cabinet 12 and a coin receptacle cabinet 14. The cabinet 14 includes a pivotal coin-receiving panel 16 provided with a coin slot 18 for receiving currency required to actuate the latching mechanism (not shown) to effect release of the front panel of dispensing cabinet 12. Also provided on front panel 16 are a bent coin release button 20 and a bent coin return 22 as is conventional.

Figure 2:
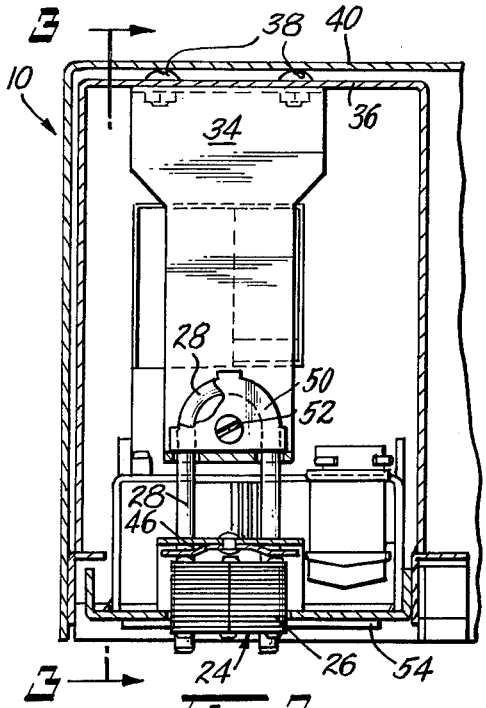
FIG. 2 is an enlarged fragmentary horizontal sectional view, taken on line 2—2 of FIG. 1.
Figure 4:
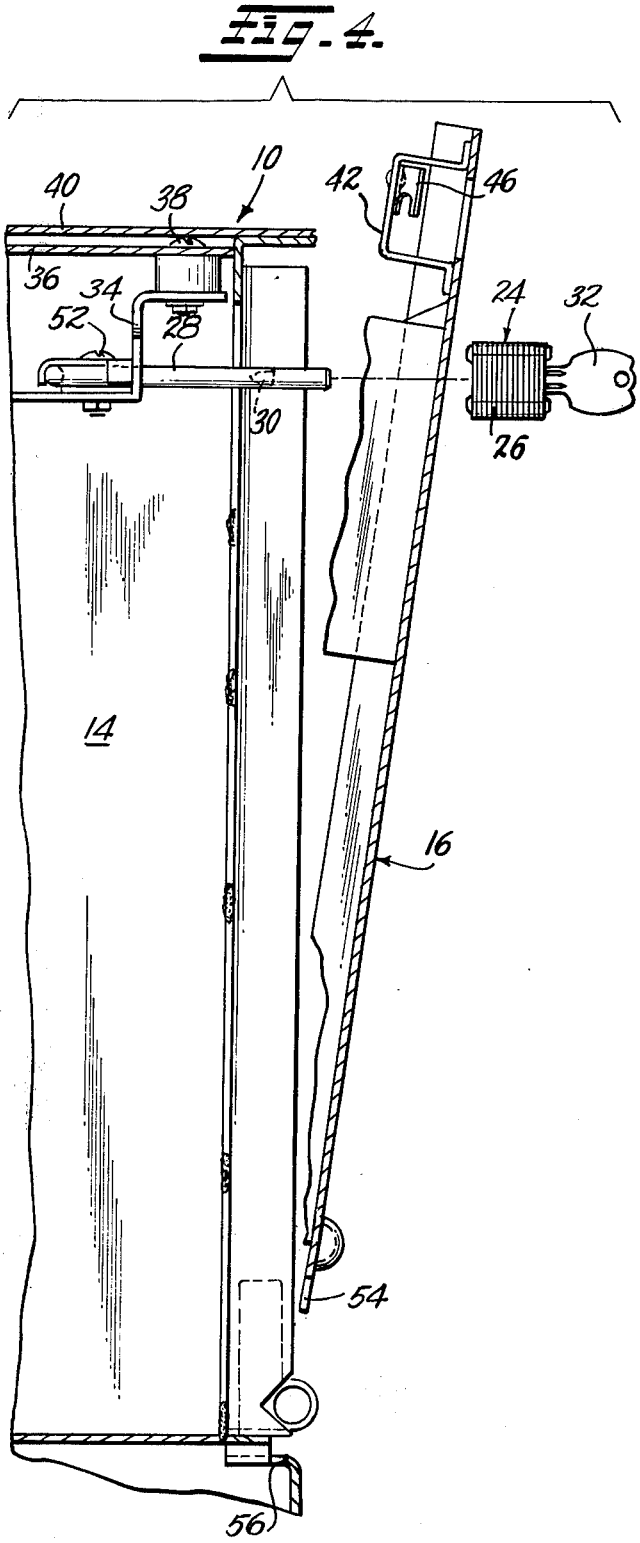
FIG. 4 is an exploded fragmentary vertical sectional view similar to FIG. 3, but showing the front coin-receiving panel unlocked and removed slightly from the cabinet.
Figure 3:
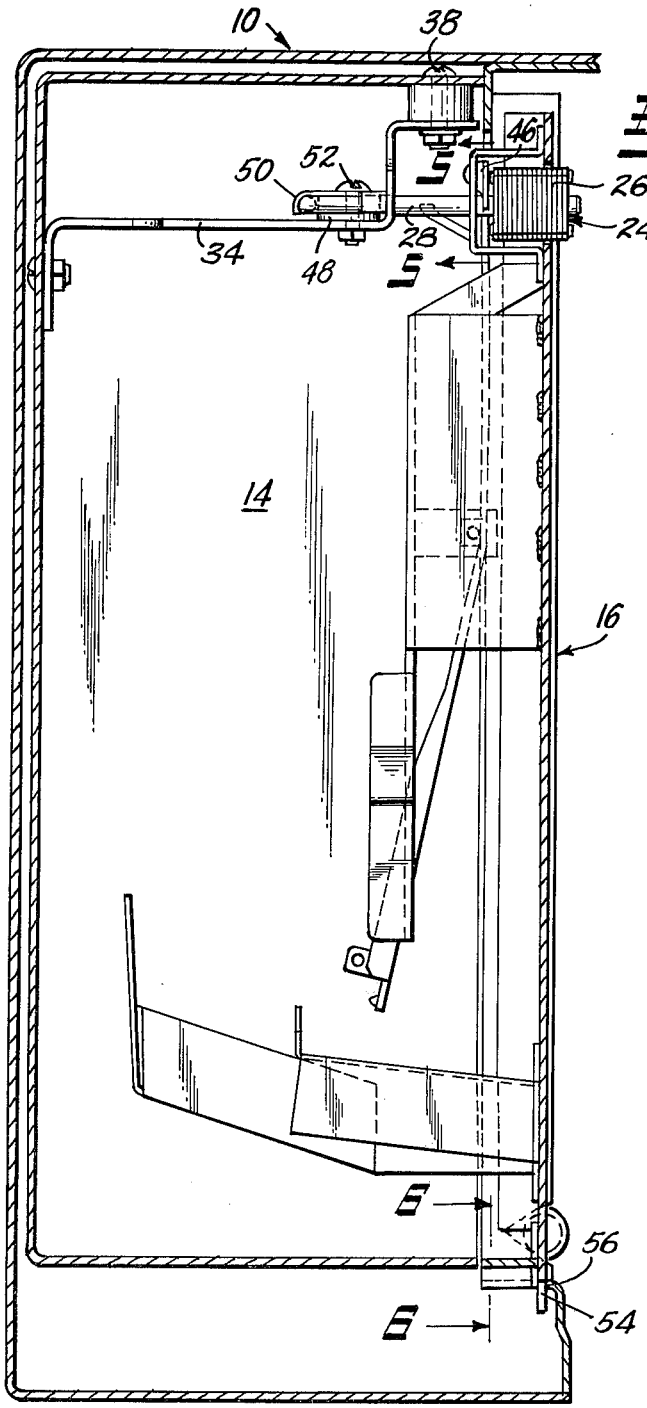
FIG. 3 is a fragmentary vertical sectional view, taken on line 3—3 of FIG. 2.
Figure 5:
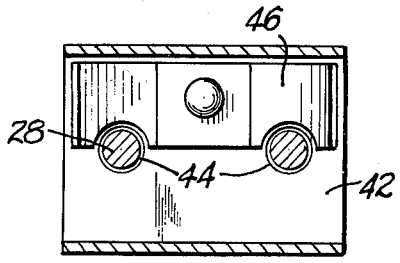
FIG. 5 is an enlarged vertical sectional view, taken on line 5—5 of FIG. 3 showing the location of the lock spring.
Figure 7:
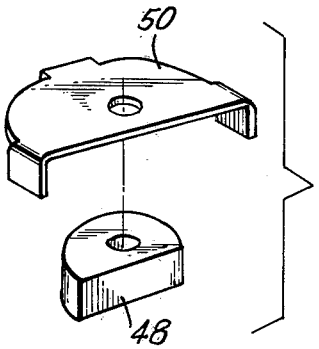
FIG. 7 is an exploded perspective view of the keeper elements for the staple of the lock.
Figure 6:
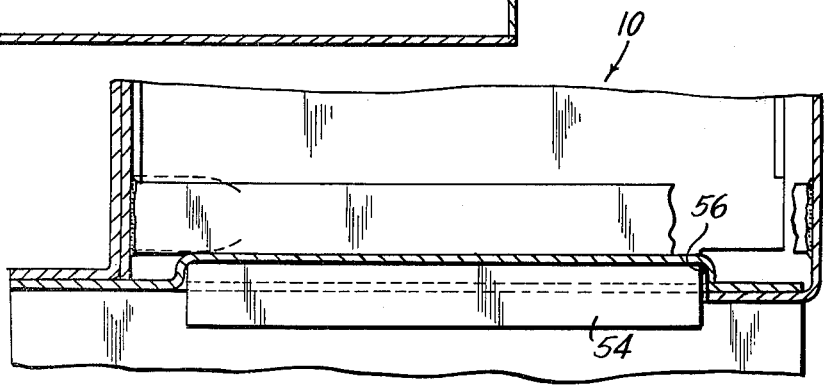
FIG. 6 is an enlarged fragmentary transverse vertical sectional view, taken on the line 6—6 of FIG. 3.

The pivotal coin-receiving panel 16 is further provided with a positive locking means indicated generally as 24 in FIG. 1 and comprised of a lock body member 26 which cooperates with a lock shaft member 28 as best viewed in FIGS. 2 and 4. The lock may be of any conventional design provided, however, the body and shaft members are capable of complete disengagement. Typically, the lock shaft member will be provided with notches 30 which cooperate with corresponding detents (not shown) carried within the lock body member. Usually, but not necessarily, the separation of the body member 26 from shaft member 28 is accomplished by a key 32.

The lock shaft member 28 is securely affixed within the coin-receptacle cabinet 14 by means of an offset bracket 34 fastened, for example, to an interior wall 36 by means of suitable fasteners 38. An outer wall 40 may then be provided to preclude tampering with fasteners 38.

As best viewed in FIG. 4, the coin-receiving panel 16 is provided with a recessed area 42 whose configuration closely corresponds to that of the cross-section of lock body member 26. The recess 42 is formed with holes 44 therein whereby the projecting, lock shaft member 28 may protrude outwardly from its position within receptacle cabinet 14 through holes 44 and into locking engagement with lock body member 26. Additionally, there is provided a spring member 46 which biases lock body member 26 outwardly to facilitate removal thereof.

As shown in FIGS. 2–4 and 7, lock shaft member 28 is securely affixed to offset bracket 34 by means of a semicircular inner guide member 48 in cooperation with an outer, concentric guide member 50, each of which is positioned by means of fastener 52 thereby defining a U-shaped annular channel adapted to receive and positively affix the U-shaped portion of shaft member 28. Should the skilled artisan desire to employ a lock whose shaft member differs from that of member 28, obvious modifications may be made to inner and outer guide members 48, 50 to ensure adequate attachment to offset bracket 34.

As noted above, the front, coin-receiving panel 16 is pivotal to facilitate entry to the coin-receptacle cabinet 14. Optionally, the front panel 16 may be entirely removed from cabinet 14. To achieve these results, the front panel 16 is provided with a tongue 54 adapted for insertion within a slot 56 formed at the lower edge of coin-receptacle cabinet 14. Accordingly, when lock body member 26 is removed from engagement with lock shaft member 28, the front panel 16 may be pivoted outwardly about the hinge formed by tongue 54 and slot 56. Complete removal of front panel 16, should it be desirable, is achieved by simply lifting the panel upwardly to disengage tongue 54 from slot 56, as shown in FIG. 4. It should be noted that the pivotally-detachable feature will not reduce the tamper-proof characteristics of the present invention since it is not possible to extract tongue 54 from slot 56 while the panel is locked.

While the invention has been described and illustrated with reference to a certan preferred embodiment thereof, those skilled in the art will appreciate that various modifications, changes, omissions and substitutions can be made without departing from the spirit of the invention. It is intended, therefore, that the invention be limited only by the scope of the following claims.

What is claimed is:

1. In a coin-operated vending machine including a coin-receiving enclosure having a front panel attached thereto allowing access to said enclosure and provided with a locking mechanism, the improvement comprising:

a. locking means having a lock body member including at least one axial aperture therein extending at least partially through said body member, and a cooperating lock shaft member adapted for insertion into said aperture for locking engagement therewith;

b. recess means having side walls and a bottom wall formed in said front panel receiving said lock body member and including apertures in said bottom wall corresponding with said aperture in said lock body member, said recess means receiving said lock body member in cooperating relationship whereby only the outer end face of said lock body member is presented for access; and c. means disposed interiorly said enclosure securely affixing said lock shaft member therein with said lock shaft member extending outwardly through said apertures in said recess into locking relationship with said lock body member, thereby securely affixing said front panel to said coin-receiving enclosure.

2. In a vending machine as defined in claim 1, further including spring means affixed to said bottom wall biasing said lock body member outwardly relatively to said front panel.

3. In a vending machine as defined in claim 1, wherein said lock body member has two axial apertures and said lock shaft member is U-shaped.

4. In a vending machine as defined in claim 3, wherein said affixing means includes:

a. an offset bracket fastened to the interior of said enclosure;

b. a first guide member fastened to said bracket; and c. a second guide member fastened to said bracket, exteriorly concentric with said first guide member to define a U-shaped annular guide for receiving and affixing said lock shaft member.

5. In a vending machine as defined in claim 1, wherein:

a. said front panel has a tongue formed at its lower peripheral edge; and, b. said coin-receiving enclosure has a slot formed at its lower peripheral edge for receiving said tongue, whereby said front panel is capable of being both pivoted and detached.

* * * * *